US010847906B2

(12) United States Patent
Yanase et al.

(10) Patent No.: US 10,847,906 B2
(45) Date of Patent: Nov. 24, 2020

(54) CONNECTION SWITCHING DEVICE

(71) Applicant: SMK Corporation, Tokyo (JP)

(72) Inventors: Tomoyasu Yanase, Tokyo (JP); Kiyoshi Asai, Tokyo (JP); Hiroyasu Kamatani, Tokyo (JP)

(73) Assignee: SMK Corporation, Tokyo (JP)

( * ) Notice: Subject to any disclaimer, the term of this patent is extended or adjusted under 35 U.S.C. 154(b) by 0 days.

(21) Appl. No.: 16/597,303

(22) Filed: Oct. 9, 2019

(65) Prior Publication Data

US 2020/0119470 A1 Apr. 16, 2020

(30) Foreign Application Priority Data

Oct. 12, 2018 (JP) ..... 2018-193189

(51) Int. Cl.

| | |
|---|---|
| ***H01R 13/24*** | (2006.01) |
| ***H01R 9/05*** | (2006.01) |
| ***H01R 13/6584*** | (2011.01) |
| ***H01R 13/635*** | (2006.01) |
| ***H01R 9/053*** | (2006.01) |

(52) U.S. Cl.

CPC ..... *H01R 9/0527* (2013.01); *H01R 9/053* (2013.01); *H01R 13/635* (2013.01); *H01R 13/6584* (2013.01)

(58) Field of Classification Search

CPC ..... H01R 29/00; H01R 12/00; H01R 12/716; H01R 13/2442; H01R 13/6582; H01R 13/245; H01R 13/2457; H01R 13/2492; H01R 13/11; H01R 13/115; H01R 9/053; H01R 9/0527; H01R 13/635; H01R 13/6584

USPC ..... 439/63, 71, 83, 188, 944

See application file for complete search history.

(56) References Cited

U.S. PATENT DOCUMENTS

| | | | | |
|---|---|---|---|---|
| 6,808,405 | B1 * | 10/2004 | Uratani | H01R 13/7037 439/188 |
| 7,794,253 | B2 * | 9/2010 | Wang | H01R 24/46 439/188 |
| 9,935,400 | B1 * | 4/2018 | Ejiri | H01R 13/64 |

FOREIGN PATENT DOCUMENTS

| | | | |
|---|---|---|---|
| JP | 2008-226588 | A | 9/2008 |
| JP | 2012-054012 | A | 3/2012 |
| JP | 2013-004361 | A | 1/2013 |

* cited by examiner

*Primary Examiner* — Edwin A. Leon
*Assistant Examiner* — Milagros Jeancharles
(74) *Attorney, Agent, or Firm* — Locke Lord LLP

(57) ABSTRACT

A connection switching device is provided which connects a plug, having a plug pin connected to an inspecting circuit, to a receptacle connector connecting an antenna and a transmission/reception circuit, and switches a connection to a parallel connection where the inspection circuit is connected to the antenna and to the transmission/reception circuit. The receptacle connector includes a first contact, a second contact, and a normally closed terminal that is brought into elastic contact with the first contact and the second contact. The plug includes a first plug pin being brought into contact with the first contact, a second plug pin being brought into contact with the second contact, and an insulating projection being inserted between at least one of the first and second contacts and the normally closed terminal to insulate between the at least one of the first and second contacts and the normally closed terminal.

20 Claims, 9 Drawing Sheets

CONNECTION SWITCHING DEVICE

FIELD

The present invention relates to connection switching devices for switching a connection between a common terminal and a normally closed terminal in a receptacle connector to a connection between the common terminal and a plug pin of a plug, when the plug is connected to the receptacle connector. The present invention more particularly relates to a connection switching device for switching a connection destination of a transmission/reception circuit that is connected to an antenna in a normal state, to an inspecting circuit that is connected to a plug pin of a plug when the plug is connected.

BACKGROUND

Mobile communication apparatuses, such as portable telephones, have an antenna and a transmission/reception circuit which transmits and receives an antenna signal incorporated in the communication apparatuses. Before the mobile communication apparatuses are shipped, the operation of the incorporated transmission/reception circuit is inspected by connecting the antenna and the transmission/reception circuit through a coaxial connector with a switch, the coaxial connector with a switch having a common terminal connected to the transmission/reception circuit, and a normally closed terminal connected to the antenna. At the time of inspecting the operation of the transmission/reception circuit, a plug is connected to the coaxial connector with a switch to disconnect a break terminal from the common terminal. At the same time, a plug pin of the plug connected to an inspecting circuit is brought into contact with the common terminal so as to switch a connection destination of the transmission/reception circuit from the antenna to the inspecting circuit for inspection of the operation of the transmission/reception circuit.

There are also demands for connecting a plug to the coaxial connector with a switch to connect the antenna to the inspecting circuit, in order to examine the influence of noise on the antenna side or to conduct adjustment and inspection of the impedance of the antenna, or the like. Patent Literature 1 and Patent Literature 2 disclose conventional connection switching devices configured such that an inspecting circuit is connectable to both the transmission/reception circuit and the antenna through the plug pin of a plug connected to the coaxial connector with a switch.

Among the connection switching devices, a connection switching device 100 disclosed in Patent Literature 1 will be described with reference to FIG. 12. The connection switching device 100 includes a receptacle connector 101 having a first movable terminal 102, a second movable terminal 103, and a normally closed terminal 104 that are attached to an insulating housing 105. The connection switching device 100 also includes a plug 110 removably connected to the receptacle connector 101. The insulating housing 105 has a switch chamber 105*a* formed as a recess from a bottom face side, with the normally closed terminal 104 being exposed along an inner top face of the switch chamber 105*a*. One side of the normally closed terminal 104 is in elastic contact with the first movable terminal 102, and the other side is in elastic contact with the second movable terminal 103, and the first and second movable terminals 102 and 103 are supported by the insulating housing 105 in a cantilever manner. The inner top face of the switch chamber 105*a*, to which the normally closed terminal 104 is attached, has a plug pin insertion hole 108 formed to permit insertion of a plug pin 111 of the plug 110 so that the plug pin 111 comes into contact with the normally closed terminal 104.

The first movable terminal 102 has an upper surface fixed to an insulating projection 106, and the second movable terminal 103 has an upper surface fixed to an insulating projection 107. The insulating projections 106 and 107 extend through the insulating housing 105 so as to appear above the insulating housing 105 in collaboration with the movement of the first movable terminal 102 and the second movable terminal 103. The other side of the first movable terminal 102 is electrically connected to a not-illustrated antenna through a signal pattern 109*a* of a printed-circuit board on which the receptacle connector 101 is mounted, while the other side of the second movable terminal 103 is electrically connected to a not-illustrated transmission/reception circuit through a signal pattern 109*b* of the printed-circuit board. In a normal state, the antenna and the transmission/reception circuit are electrically connected through the normally closed terminal 104, which are in elastic contact with the first movable terminal 102 and the second movable terminal 103.

The plug 110 includes a needlelike plug pin 111 that is connected to the inspecting circuit, and a projecting portion 112 formed in one place in the circumference of the plug pin 111. In the case of connecting an inspecting circuit to the transmission/reception circuit, the plug 110 is connected to the receptacle connector 101 in an illustrated direction, with the plug pin 111 being inserted into the plug pin insertion hole 108 to be in contact with the normally closed terminal 104, while the projecting portion 112 of the plug 110 depresses the insulating projection 106 so as to separate the first movable terminal 102 from the normally closed terminal 104 and to thereby insulate between the first movable terminal 102 and the normally closed terminal 104. As a result, a connection destination of the transmission/reception circuit is switched from the antenna to the inspecting circuit.

In the case of connecting the inspecting circuit to the antenna, the plug 110 is connected to the receptacle connector 101 in the direction that the projecting portion 112 is positioned on the right side that is opposite to the illustrated direction, with the plug pin 111 being inserted into the plug pin insertion hole 108 and brought into contact with the normally closed terminal 104. Simultaneously, the projecting portion 112 of the plug 110 depresses the insulating projection 107 illustrated on the right side so as to separate the second movable terminal 103 from the normally closed terminal 104 and thereby insulate between the second movable terminal 103 and the normally closed terminal 104. As a result, a connection destination of the antenna is switched from the transmission/reception circuit to the inspecting circuit.

In a connection switching device 120 disclosed in Patent Literature 3, a pair of coaxial connectors with a switch 121 illustrated in FIG. 13 is prepared, and the coaxial connectors are connected in series between an antenna and a transmission/reception circuit in directions opposite to each other. That is, a common terminal 122 of one coaxial connector 121 is connected to the antenna, while a common terminal 122 of the other coaxial connector 121 is connected to the transmission/reception circuit, and normally closed terminals 123 of both the coaxial connectors 121 are electrically connected to each other. Therefore, in the normal state where both of the two coaxial connectors with a switch 121 are not connected to a plug 130, the antenna and the transmission/reception circuit are connected through a pair of the coaxial connectors 121.

As illustrated in the drawing, when the plug 130 is connected to one of the coaxial connectors with a switch 121, and a plug pin 131 of the plug 130 depresses the common terminal 122, the plug pin 131 that is connected to an inspecting circuit is connected to the antenna or the transmission/reception circuit which is connected to the common terminal 122, and the common terminal 122 is separated from the normally closed terminal 123, so that the antenna and the transmission/reception circuit are disconnected.

According to the connection switching device 120, when the plug 130 includes a pair of plug pins 131 which are connected to the inspecting circuit, the plug pins 131 depress the common terminals 122 of the coaxial connectors with a switch 121, so that the antenna and the transmission/reception circuit are disconnected, while the plug pins 131 are brought into contact with the common terminals 122, so that both the antenna and the transmission/reception circuit can be connected to the inspecting circuit.

CITATION LIST

Patent Literature

Patent Literature 1: Japanese Patent Application Laid-Open No. 2012-054012

Patent Literature 2: Japanese Patent Application Laid-Open No. 2008-226588

Patent Literature 3: Japanese Patent Application Laid-Open No. 2013-004361

SUMMARY

Technical Problem

In the aforementioned conventional connection switching device 100, whenever an inspecting circuit is connected to the antenna or the transmission/reception circuit, it is necessary to change the direction of the plug 110 before connecting the plug 110 to the receptacle connector 101. It is also not possible to connect the inspecting circuit with the antenna and the transmission/reception circuit at the same time. This makes it impossible to inspect the operation of the transmission/reception circuit in consideration of the influence of noise input into the antenna.

The connection switching device 120 allows connection of both the antenna and the transmission/reception circuit to the inspecting circuit at the same time in parallel. However, using the pair of coaxial connectors with a switch 121 causes cost increase, and also necessitates securing a mounting space for mounting the coaxial connectors with a switch 121 on a circuit board having a signal pattern wired to connect the antenna and the transmission/reception circuit in the communication apparatus. Hence, the connection switching device 120 is not practical since it also disturbs downsizing of the communication apparatus.

In the conventional connection switching device 100, even when the first movable terminal 102 or the second movable terminal 103 is separated from the normally closed terminal 104, the first movable terminal 102 or the second movable terminal 103 is still in a state adjacent to the normally closed terminal 104 that is connected to the inspecting circuit. Accordingly, it is difficult to secure a sufficient isolation of the inspecting circuit from the antenna that is connected to the first movable terminal 102, or from the transmission/reception circuit that is connected to the second movable terminal 103, and this causes a problem that noise and an antenna signal leak to the inspecting circuit from the disconnected antenna or transmission/reception circuit.

Similarly, in the connection switching device 120, the normally closed terminal 123 which is depressed by the plug pin 131 and separated from the common terminal 122 is also in the state adjacent to the common terminal 122. Accordingly, a signal transmission line between the inspecting circuit and the antenna, and a signal transmission line between the inspecting circuit and the transmission/reception circuit may cause high frequency coupling through the normally closed terminal 123, and this poses a problem that the signal transmission lines are not sufficiently isolated.

The present invention has been made in consideration of the aforementioned problems, and it is an object of the present intention to provide a connection switching device that connects a plug, having a plug pin connected to an inspecting circuit, to a receptacle connector connecting an antenna and a transmission/reception circuit, and switches a connection to a parallel connection where the inspection circuit is connected to the antenna and to the transmission/reception circuit.

It is also an object of the present invention to provide a connection switching device offering a high isolation between a signal transmission line between the inspecting circuit and the antenna and a signal transmission line between the inspecting circuit and the transmission/reception circuit.

Solution to Problem

In order to accomplish the above-described objects, a connection switching device according to a first aspect is a connection switching device configured to connect a plug having a first plug pin to a receptacle connector, the receptacle connector having a first contact and a second contact that are attached to an insulating housing, the connection switching device being configured to switch an electrical connection between the first contact and the second contact to an electrical connection between the first contact and the first plug pin, wherein the receptacle connector includes: the first contact having a first elastic contact piece; the second contact having a second elastic contact piece; and a normally closed terminal that is attached between the first contact and the second contact of the insulating housing, the normally closed terminal being brought into elastic contact with the first elastic contact piece and the second elastic contact piece, the plug includes: the first plug pin; a second plug pin, and an insulating projection, the first plug pin being brought into contact with the first contact, the second plug pin being brought into contact with the second contact, and the insulating projection being inserted between the first elastic contact piece and the normally closed terminal and/or between the second elastic contact piece and the normally closed terminal to insulate between the first elastic contact piece and/or the second elastic contact piece and the normally closed terminal, when the plug is electrically connected to the receptacle connector, and when the receptacle connector and the plug are connected to each other, the first contact and the first plug pin are electrically connected to each other, and the second contact and the second plug pin are electrically connected to each other.

In a normal state where the plug is not connected to the receptacle connector, the first contact and the second contact are electrically connected through the normally closed terminal that is brought into elastic contact with the first elastic contact piece and the second elastic contact piece. When the plug is connected to the receptacle connector, the insulating projection of the plug insulates between at least one of the first elastic contact piece and the second elastic contact piece, and the normally closed terminal, and the first plug pin is brought into contact with the first contact to establish an electrical connection, while the second plug is brought into contact with the second contact to establish an electrical connection.

In the connection switching device according to a second aspect, the plug includes: the first plug pin that is brought into contact with the first contact; the second plug pin that is brought into contact with the second contact; the insulating projection that is inserted between the first elastic contact piece and the normally closed terminal and between the second elastic contact piece and the normally closed terminal to insulate between the first elastic contact piece and the normally closed terminal and between the second elastic contact piece and the normally closed terminal; and a ground terminal that is connected to a ground, the ground terminal being projected along the insulating projection, and when the plug is connected to the receptacle connector, the ground terminal is brought into contact with the normally closed terminal.

When the plug is connected to the receptacle connector, the ground terminal that is connected to the ground is brought into contact with the normally closed terminal that is separated from the first elastic contact piece and the second elastic contact piece. As a result, the first contact is shielded from the second contact by the normally closed terminal having electric potential changed to the electric potential of a shield conductor.

In the connection switching device according to a third aspect, the first contact is connected to a transmission/reception circuit that transmits and/or receives an antenna signal, the second contact is connected to a feeding point of the antenna, and the first plug pin and the second plug pin are probes that are connected to a detection circuit that detects an RF signal flowing to the transmission/reception circuit or to the antenna.

In the normal state where the plug is not connected to the receptacle connector, the feeding point of the antenna and the transmission/reception circuit that transmits and/or receives the antenna signal are electrically connected through the normally closed terminal. When the plug is connected to the receptacle connector, the feeding point of the antenna is insulated from the transmission/reception circuit, and the feeding point of the antenna and the transmission/reception circuit are electrically connected to the detection circuit that detects an RF signal flowing to the transmission/reception circuit or to the antenna, respectively.

In the connection switching device according to a fourth aspect, the first contact and the second contact are identical in shape.

One kind of contact can be used as the first contact and the second contact.

In the connection switching device according to a fifth aspect, the first contact and the second contact are attached to the insulating housing at positions point-symmetric with respect to the normally closed terminal.

Since the first contact and the second contact are identical in shape and disposed in point symmetry with respect to the normally closed terminal, the first contact and the second contact have identical characteristic impedance, so that two kinds of transmission routes that deliver the antenna signal, including one route through the first contact, and the other route through the second contact, have identical transmission characteristics.

In the connection switching device according to a sixth aspect, a first plate electrode portion is integrally formed on a side of the first elastic contact piece of the first contact, the first plate electrode portion being brought into contact with the first plug pin of the plug, and a second plate electrode portion is integrally formed on a side of the second elastic contact piece of the second contact, the second plate electrode portion being brought into contact with the second plug pin of the plug.

Since the first contact and the second contact are attached to the insulating housing at the positions point-symmetric with respect to the normally closed terminal, the first plate electrode portion and the second plate electrode portion are disposed in free space on the side of the space where the first elastic contact piece and the second elastic contact piece are brought into elastic contact with the normally closed terminal.

A connection switching device according to a seventh aspect is a connection switching device configured to connect a plug having a first plug pin to a receptacle connector, the receptacle connector having a first contact and a second contact that are attached to an insulating housing, the connection switching device being configured to switch an electrical connection between the first contact and the second contact to an electrical connection between the first contact and the first plug pin, wherein the receptacle connector includes: the first contact having a first elastic contact piece; the second contact having a second elastic contact piece; and a normally closed terminal that is attached between the first contact and the second contact in the insulating housing, the normally closed terminal being brought into elastic contact with the first elastic contact piece and the second elastic contact piece, the plug includes: the first plug pin; and a second plug pin, the first plug pin being brought into contact with the first elastic contact piece to separate the first elastic contact piece from the normally closed terminal, the second plug pin being brought into contact with the second elastic contact piece to separate the second elastic contact piece from the normally closed terminal, when the plug is connected to the receptacle connector, and when the receptacle connector and the plug are connected to each other, the first contact and the first plug pin are electrically connected to each other, and the second contact and the second plug pin are electrically connected to each other.

In the normal state where the plug is not connected to the receptacle connector, the first contact and the second contact are electrically connected through the normally closed terminal that are brought into elastic contact with the first elastic contact piece and the second elastic contact piece. When the plug is connected to the receptacle connector, the first plug pin is brought into contact with the first elastic contact piece, and the second plug pin is brought into contact with the second elastic contact piece, so that the first plug pin is electrically connected to the first contact, and the second plug pin is electrically connected to the second contact, while the first elastic contact piece and the second elastic contact piece are separated from the normally closed terminal.

In the connection switching device according to an eighth aspect, the plug includes: the first plug pin; the second plug pin that is brought into contact with the second elastic contact piece to separate the second elastic contact piece from the normally closed terminal; and a ground terminal that is connected to a ground, and when the plug is connected to the receptacle connector, the ground terminal is brought into contact with the normally closed terminal.

When the plug is connected to the receptacle connector, the ground terminal that is connected to the ground is brought into contact with the normally closed terminal that is separated from the first elastic contact piece and the second elastic contact piece. As a result, the first contact is shielded from the second contact by the normally closed terminal having electric potential changed to the electric potential of a shield conductor.

In the connection switching device according to a ninth aspect, the first contact is connected to a transmission/reception circuit that transmits and/or receives an antenna signal, the second contact is connected to a feeding point of the antenna, and the first plug pin and the second plug pin are probes that are connected to a detection circuit that detects an RF signal flowing to the transmission/reception circuit or to the antenna.

In the normal state where the plug is not connected to the receptacle connector, the feeding point of the antenna and the transmission/reception circuit that transmits and/or receives the antenna signal are electrically connected through the normally closed terminal. When the plug is connected to the receptacle connector, the feeding point of the antenna is insulated from the transmission/reception circuit, and the feeding point of the antenna and the transmission/reception circuit are electrically connected to the detection circuit that detects an RF signal flowing to the transmission/reception circuit or to the antenna, respectively.

Advantageous Effects of Invention

According to the invention in the first and seventh aspects, when the plug is connected to the receptacle connector, the signal transmission route between the first contact and the second contact can be switched to two parallel signal transmission routes including a signal transmission route between the first plug pin and the first contact, and a signal transmission route between the second plug pin and the second contact.

According to the invention in the second and eighth aspects, the signal transmission line between the first plug pin and the first contact is shielded from the signal transmission line between the second plug pin and the second contact by the normally closed terminal having ground potential. This makes it possible to isolate between the two kinds of signal transmission lines.

Since the normally closed terminal used for switching of connection is utilized to shield between the two kinds of signal transmission lines, it is not necessary to dispose another shielding member in a narrow space between the first contact and the second contact.

According to the invention in the third and ninth aspects, when the plug, having a pair of plug pins that are connected to a detection circuit that detects an RF signal flowing to the transmission/reception circuit or to the antenna, is simply connected to the receptacle connector, the detection circuit that detects the RF signal can electrically be connected to both the feeding point of the antenna and the transmission/reception circuit. Hence, in the detection circuit, the operating state of the transmission/reception circuit can be inspected in consideration of the influence of noise input from the antenna.

According to the invention in the fourth aspect, one kind of contact can be used as the first contact and the second contact, which facilitates parts control and reduces manufacturing costs.

Since attaching positions of the first contact and the second contact to the insulating housing are not identified by the difference between the first contact and the second contact, attaching the first contact and the second contact at erroneous positions can be avoided, and sufficient workability in assembling can be achieved.

According to the invention in the fifth aspect, two kinds of transmission routes including the route through the first contact and the route through the second contact have identical transmission characteristics. Hence, the RF signals flowing through the two transmission routes can be compared without considering the difference in loss between the transmission routes.

The receptacle connector can be mounted on a circuit board, without considering the direction of the first contact and the second contact.

According to the invention in the sixth aspect, the first contact having the first elastic contact piece integrated with the first plate electrode portion, and the second contact having the second elastic contact piece integrated with the second plate electrode portion can efficiently be disposed around the normally closed terminal in the insulating housing.

Moreover, the first plug pin of the plug is brought into contact with the first plate electrode portion, and the second plug pin is brought into contact with the second plate electrode portion. Since the first contact and the second contact are not equipped with a spring that moves backward and forward in a connecting direction with a flag, a thinner receptacle connector can be mounted on the circuit board in a mobile apparatus.

DESCRIPTION OF EMBODIMENTS

Figure 1:
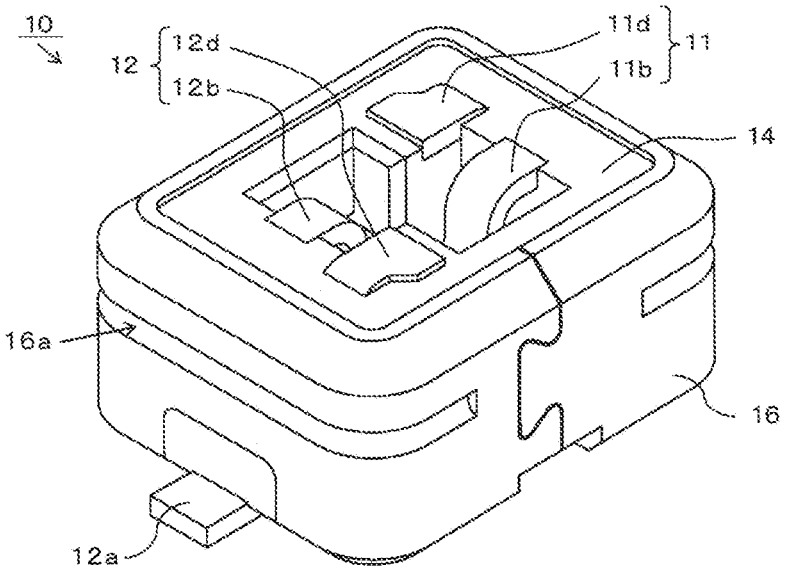
FIG. 1 is a perspective view showing a receptacle connector 10 of a connection switching device 1 according to the present invention.
Figure 2:
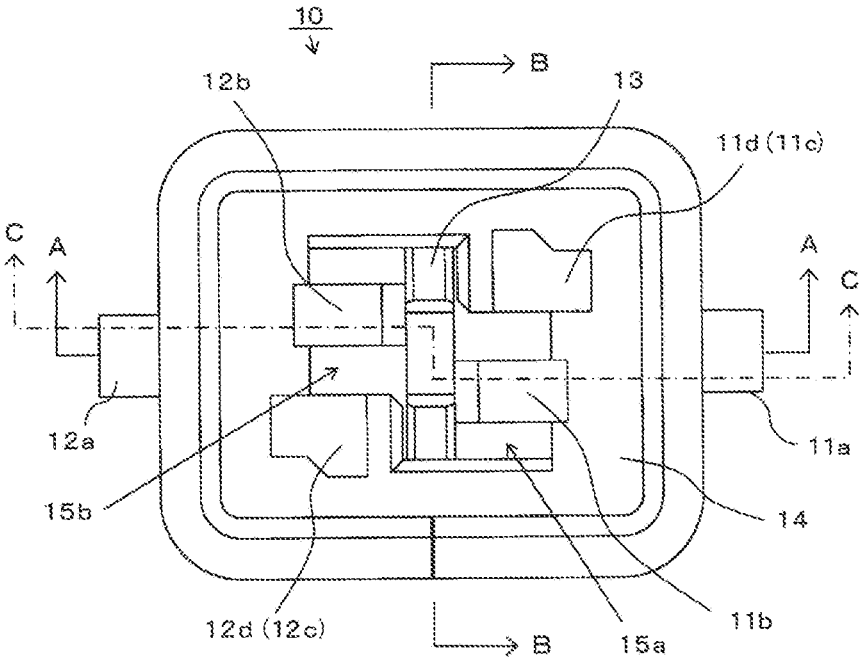
FIG. 2 is a plan view of the receptacle connector 10.

Hereinafter, a connection switching device 1 according to a first embodiment of the present invention will be described with reference to FIGS. 1 through 9. As shown in the circuit diagram of FIG. 9, the connection switching device 1 of the embodiment is configured to establish a connection by switching between a normal connection between a feeding point 2*a* of an antenna 2 and a transmission/reception circuit 3 that transmits or receives an antenna signal through or from the antenna 2, and a two-way connection in which an inspecting circuit 4 having a detection circuit that detects an RF signal flowing to the antenna 2 or to the transmission/reception circuit 3 is connected to the feeding point 2*a* of the antenna 2 and the transmission/reception circuit 3 in parallel. The connection switching device 1 includes a receptacle connector with a switch 10 (hereinafter simply referred to as receptacle connector 10) including a first contact 11 that is a first common terminal connected to the transmission/reception circuit 3, a second contact 12 that is a second common terminal connected to the feeding point 2*a* of the antenna 2, and a normally closed terminal 13, the terminals being attached to an insulating housing 14 in the state of being insulated from each other. The connection switching device 1 also includes a plug 20 that is fitted and connected to the receptacle connector 10. The receptacle connector 10 is mounted on the surface of a circuit board of an electronic communication apparatus which is not illustrated, the circuit board being mounted with the antenna 2 and the transmission/reception circuit 3.

Figure 3:
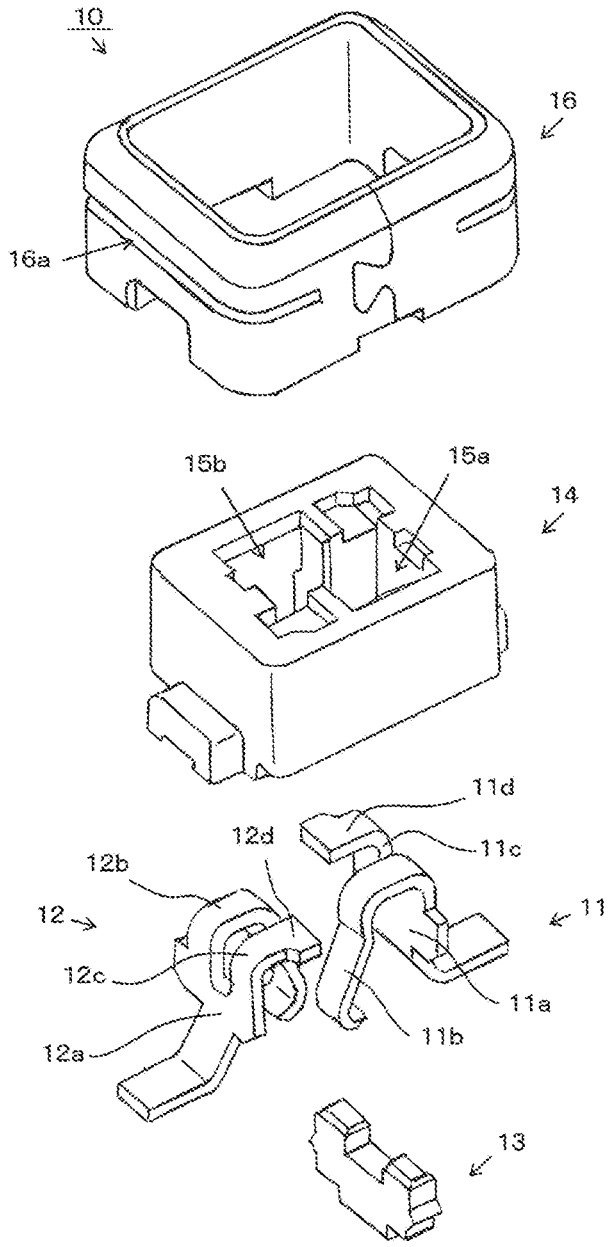
FIG. 3 is an exploded perspective view of the receptacle connector 10.
Figure 4:
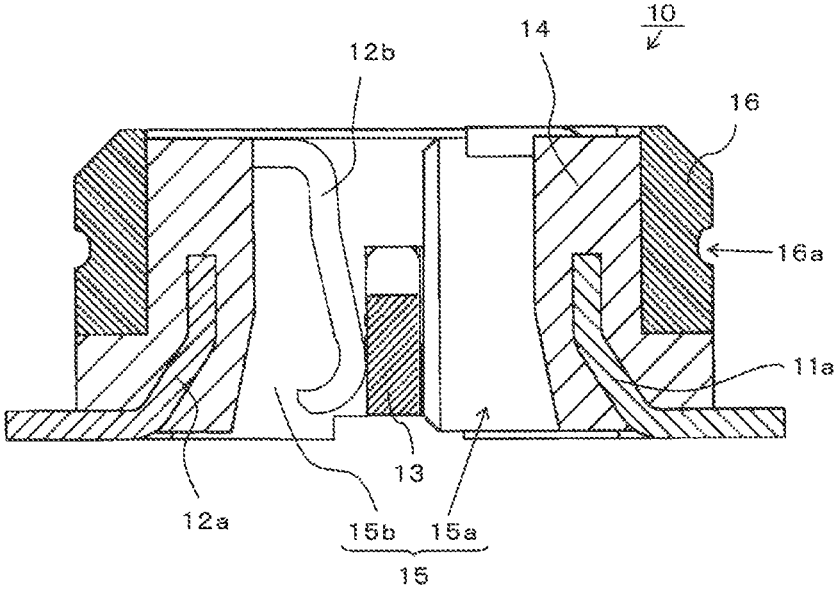
FIG. 4 is a cross-sectional view of the receptacle connector 10 of FIG. 2 taken along line A-A.
Figure 5:
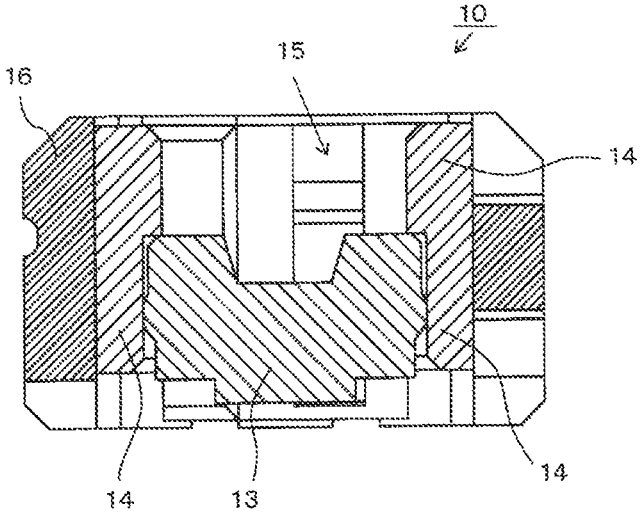
FIG. 5 is a cross-sectional view of the receptacle connector 10 of FIG. 2 taken along line B-B.

The insulating housing 14 of the receptacle connector 10 is formed into a square tube with a through hole 15 extending in a vertical direction (up-down direction in FIGS. 4 and 5). The entire insulating housing 14 has a symmetrical shape with respect to a vertical line extending through the center of the plan view. The normally closed terminal 13 is formed with a conductive metal plate into the shape of a plate as shown in FIGS. 3 through 5. The normally closed terminal 13 is press-fitted from the lower side of the insulating housing 14 into the insulating housing 14 along a space between inner wall surfaces that face each other at the center of the through hole 15, and fixed to the insulating housing 14. As the normally closed terminal 13 is press-fitted and fixed to the insulating housing 14, the through hole 15 is divided into a first plug insertion hole 15*a* that allows insertion and removal of a later-described first insulating projection plate 24*a* of the plug 20 and a second plug insertion hole 15*b* that allows insertion and removal of a second insulating projection plate 24*b*.

As shown in FIG. 3, the first contact 11 is insert-molded in the insulating housing 14, so that a fixed piece 11*a* integrally fixed to the insulating housing 14, and a first elastic contact piece 11*b* and a first fixed contact piece 11*c* bifurcated from the upper side of the fixed piece 11*a* are integrally formed by press-molding of a long plate-like conductive metal plate. The fixed piece 11*a* has one lower side that is exposed along the bottom face of the insulating housing 14 and that is solder-connected onto the pattern of a circuit board that is connected to the transmission/reception circuit 3.

Figure 6:
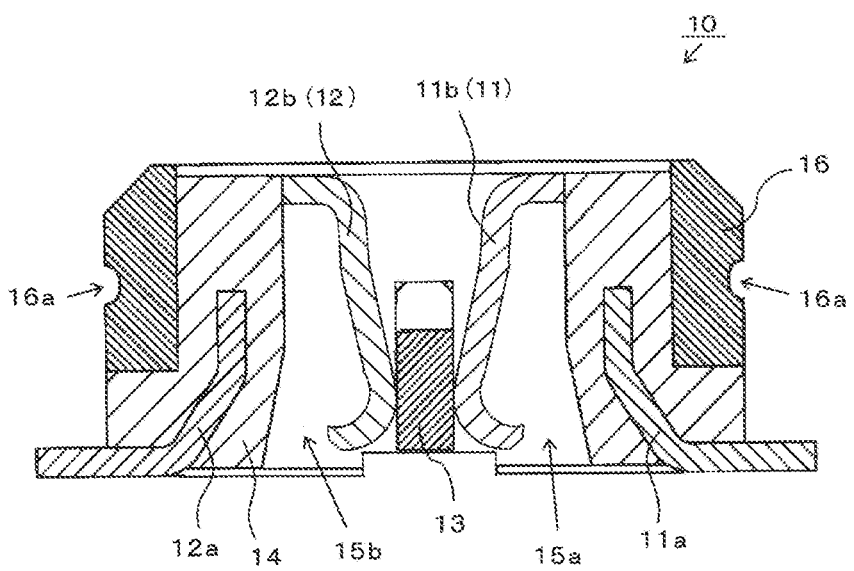
FIG. 6 is a cross-sectional view of the receptacle connector 10 of FIG. 2 taken along C-C line.

The first elastic contact piece 11*b* that is one of the bifurcated pieces is an elastic piece supported in a cantilever manner by the fixing piece 11*a* that is fixed to the insulating housing 14 such that the first elastic contact piece 11*b* can move in the first plug insertion hole 15*a*. The first elastic contact piece 11*b* is folded in a dogleg shape toward the normally closed terminal 13 that is exposed to the first plug insertion hole 15*a*, and is brought into elastic contact with a side face of the normally closed terminal 13 in a free state as shown in FIG. 6. The first fixed contact piece 11*c* that is the other bifurcated piece has a first plate electrode portion 11*d* formed by folding an upper portion of the first fixed contact piece 11*c* at right angles along the flat surface of the insulating housing 14. The first plate electrode portion 11*d* is exposed to the flat surface on the side of the first plug insertion hole 15*a*, and the first plug pin 21 comes into contact with the first plate electrode portion 11*d*.

The second contact 12 is identical to the first contact 11 that is formed by press-molding of a long plate-like conductive metal plate. The second contact 12 is provided when it is attached to the insulating housing 14 at a position that is symmetric with the first contact 11 with respect to the vertical line extending through the center of the plan view.

That is, the fixed piece 11*a*, the first elastic contact piece 11*b*, and the first fixed contact piece 11*c* of the first contact 11 correspond to the fixed piece 12*a*, the second elastic contact piece 12*b*, and the second fixed contact piece 12*c* of the second contact 12, respectively. A portion of the fixed piece 12*a* exposed along the bottom face of the insulating housing 14 is solder-connected to the pattern of the circuit board connected to the feeding point 2*a* of the antenna 2. The second elastic contact piece 12*b* is folded in a dogleg shape toward the normally closed terminal 13 inside the second plug insertion hole 15*b*, and is brought into elastic contact with the side face of the normally closed terminal 13 in a free state as shown in FIG. 6. The second plate electrode portion 12*d* folded at right angles along the flat surface of the insulating housing 14 on the upper side of the second fixed contact piece 12*c* is exposed to the flat surface on the side of the second plug insertion hole 15*b* at the position diagonal to the first plate electrode portion 11*d*. The second plug pin 22 comes into contact with the second plate electrode portion 12*d*.

As shown in FIG. 3, the receptacle connector 10 further includes an earth shell 16 that surrounds the entire side face of the cubic tube-shaped insulating housing 14. The earth shell 16 is formed into the shape of a rectangular frame shown in the drawing by bending a conductive metal plate. The earth shell 16 has a lower end solder-connected to a ground pattern of the circuit board on which the receptacle connector 10 is mounted. As a consequence, the first contact 11 and the second contact 12 which are disposed in the inner side of the insulating housing 14 are shielded. A ring recess portion 16*a* is recessed on the circumference of the earth shell 16. When the plug 20 is connected to the receptacle connector 10, a later-described cylindrical ground fitting 26 of the plug 20 is fitted onto the outside of the ring recess portion 16*a*.

Figure 7:
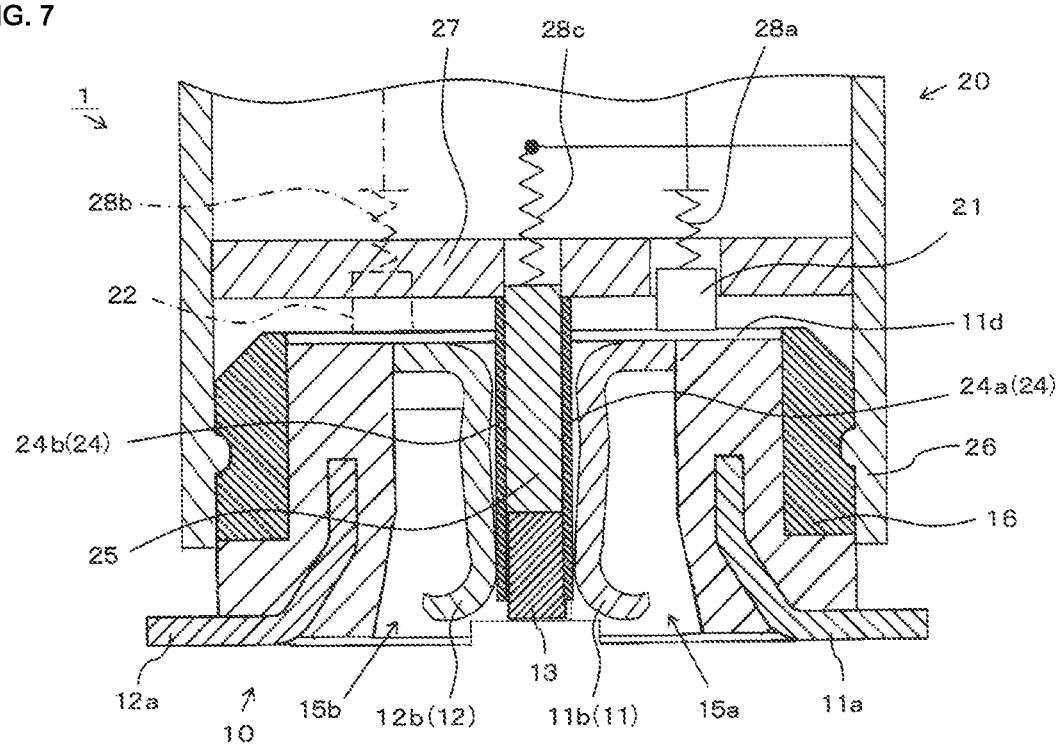
FIG. 7 is a vertical cross-sectional view of the receptacle connector 10 shown in FIG. 6 in the state of being connected to a plug 20.

As shown in FIG. 7, the plug 20 that is fitted and connected to the receptacle connector 10 has an insulating projection 24 projected therefrom. The insulating projection 24 is made of a pair of the first insulating projection plate 24*a* and the second insulating projection plate 24*b* which are inserted, from an insulator 27 that supports the first plug pin 21 and the second plug pin 22, along the side face of the normally closed terminal 13 inside the first plug insertion hole 15*a* and the second plug insertion hole 15*b*, respectively. As shown in FIG. 7, when the plug 20 is fitted and connected to the receptacle connector 10, the first insulating projection plate 24*a* is interposed between the normally closed terminal 13 and the first elastic contact piece 11*b*, and the second insulating projection plate 24*b* is interposed between the normally closed terminal 13 and the second elastic contact piece 12*b*, so that the first contact 11 and the second contact 12 that was electrically connected through the normally closed terminal 13 are insulated from each other.

The first plug pin 21 and the second plug pin 22, which are probes that are connected to the inspecting circuit 4 in parallel, are freely retractably positioned at diagonal positions on the insulator 27, the positions being point-symmetric with respect to the insulating projection 24. Both the first plug pin 21 and the second plug pin 22 are biased in a distal end direction (downward in the drawing) by compression springs 28*a* and 28*b* so as to project by a prescribed length from the insulator 27.

The cylindrical ground fitting 26, made of a cylindrical conductive metal plate that is fitted to the outside of the earth shell 16, is attached to the peripheral surface of the insulator 27. The cylindrical ground fitting 26 is fitted and connected to the ring recess portion 16*a* of the earth shell 16, so that the plug 20 and the receptacle connector 10 are held in the fitted and connected state.

Figure 9:
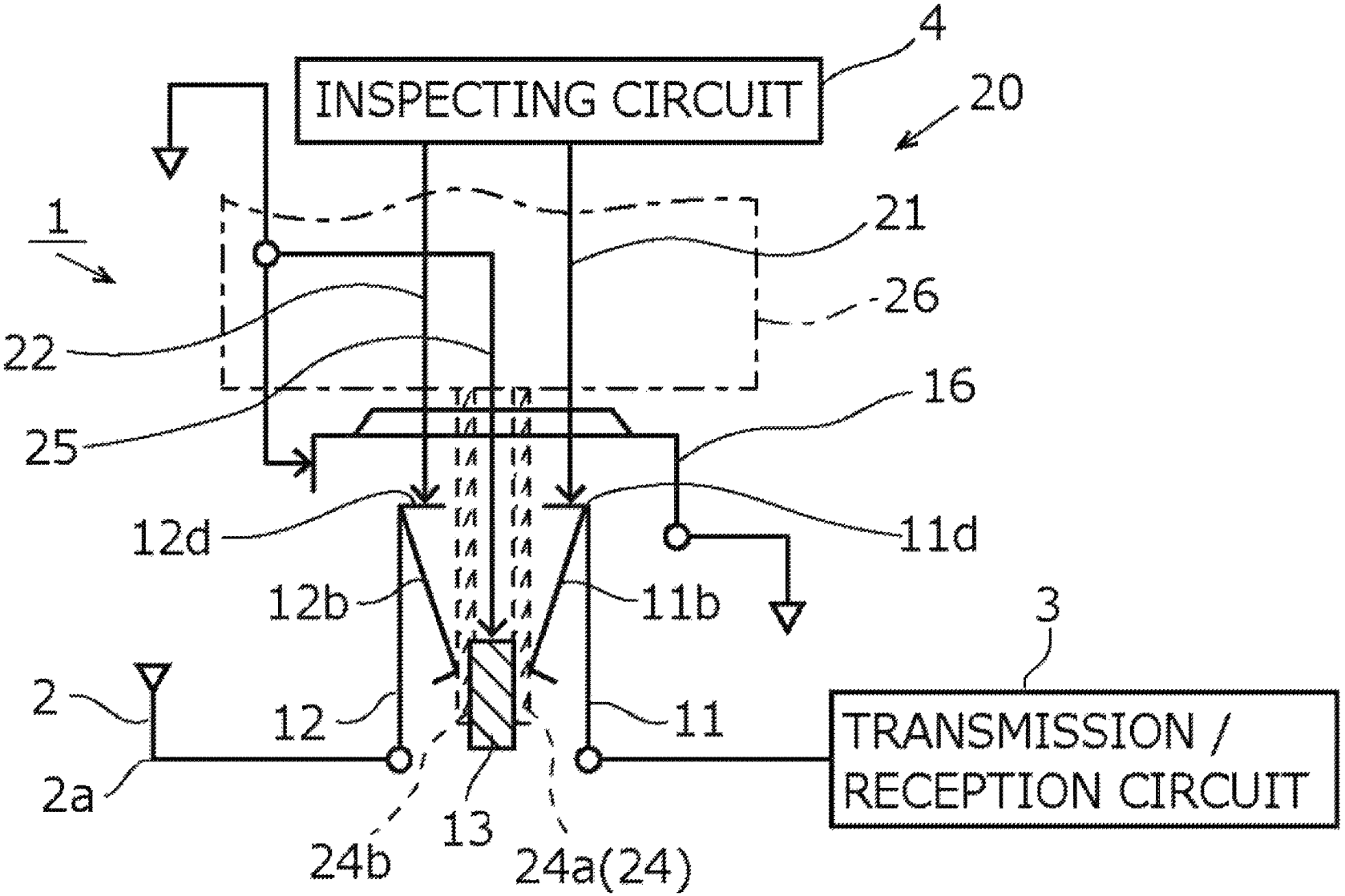
FIG. 9 is a circuit diagram of the receptacle connector 10 in the state of being connected to the plug 20.

Between the first insulating projection plate 24*a* and the second insulating projection plate 24*b*, a plate-like ground terminal 25 biased toward the distal end by the compression spring 28*c* is slidably disposed. The ground terminal 25 is connected to the cylindrical ground fitting 26 that is connected to the ground. As shown in FIG. 9, when the plug 20 is fitted and connected to the receptacle connector 10, the ground terminal 25 is brought into elastic contact with the top face (flat surface) of the normally closed terminal 13, and the potential of the normally closed terminal 13 is changed to the ground potential. The plug 20 does not necessarily need to include the cylindrical ground fitting 26. The ground terminal 25 may be connected to a portion having the ground potential other than the cylindrical ground fitting 26, and thereby change the potential of the normally closed terminal 13 to the ground potential.

Figure 8:
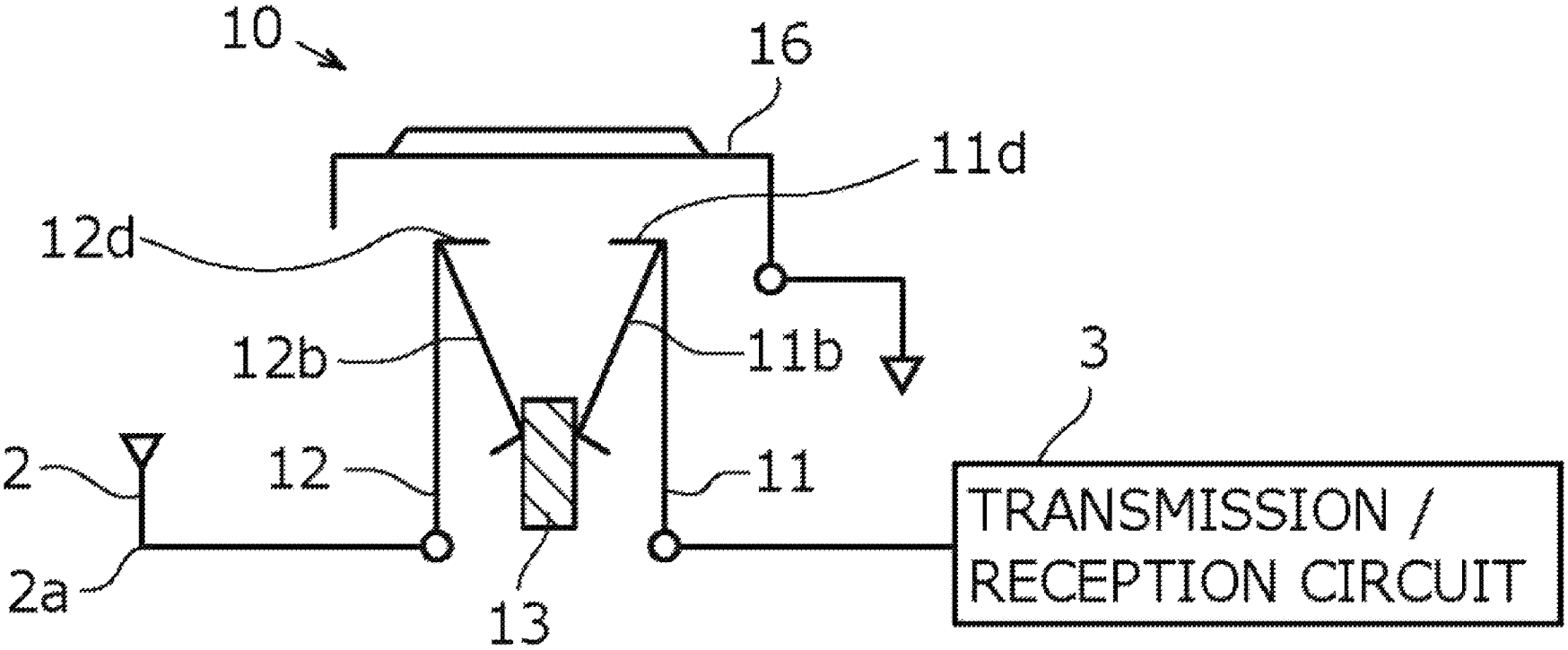
FIG. 8 is a circuit diagram of the receptacle connector 10 in a normal state where the plug 20 is not connected.

As shown in FIGS. 6 and 8, in the normal state where the plug 20 is not connected to the thus-configured receptacle connector 10, the first elastic contact piece 11*b* of the first contact 11 and the second elastic contact piece 12*b* of the second contact 12 are in elastic contact with the side surfaces of the normally closed terminal 13, respectively. As a result, the transmission/reception circuit 3 is connected to the feeding point 2*a* of the antenna 2, and transmits or receives an antenna signal through or from the antenna 2.

In the case of inspecting the transmitting and receiving state of the antenna 2 and the operation of the transmission/reception circuit 3, the plug 20 that is connected to the inspecting circuit 4 is connected to the receptacle connector 10. When the plug 20 is fitted and connected to the receptacle connector 10 as shown in FIGS. 7 and 9, the first insulating projection plate 24*a* is interposed between the normally closed terminal 13 and the first elastic contact piece 11*b*, and the second insulating projection plate 24*b* is interposed between the normally closed terminal 13 and the second elastic contact piece 12*b*, so that the first contact 11 is insulated from the second contact 12. At the same time, the first plug pin 21 and the second plug pin 22 are brought into elastic contact with the first plate electrode portion 11*d* and the second plate electrode portion 12*d* which are exposed at opposed positions. As a result, the connection is switch to a two-way connection composed of a connection between the inspecting circuit 4 and the transmission/reception circuit 3, and a connection between the inspecting circuit 4 and the antenna 2.

When the cylindrical ground fitting 26 that is connected to the ground is fitted and connected to the ring recess portion 16*a* of the earth shell 16 through the inspecting circuit 4, a signal line connecting the first contact 11 and the first plug pin 21, and a signal line connecting the second contact 12 and the second plug pin 22 are surrounded with the grounded earth shell 16 and the cylindrical ground fitting 26, so that the signal lines are shielded from the outside. At the same time, the signal line connecting the first plug pin 21 and the first contact 11 and the signal line connecting the second plug pin 22 and the second contact 12 are shielded by the ground terminal 25 being grounded and the normally closed terminal 13, so that a high isolation is achieved.

According to the present embodiment, the contacts having an identical shape can be used as the first contact 11 and the second contact 12, which makes it unnecessary to separately manage the component members of the first contact 11 and the second contact 12, and also makes it unnecessary to consider their attaching positions.

Moreover, the first contact 11 and the second contact 12 having an identical shape are attached at the point-symmetric positions on the insulating housing 14 that is formed into a point-symmetric shape. Accordingly, the fixed pieces of the contacts can be disposed on the pattern of the circuit board, without considering their directions on the circuit board, and the contact having the fixed piece solder-connected to the pattern of the circuit board that is connected to the transmission/reception circuit 3 can be used as the first contact 11, while the contact having the fixed piece solder-connected to the pattern of the circuit board that is connected to the feeding point 2*a* of the antenna 2 can be used as the second contact 12.

Since the first contact 11 and the second contact 12 having an identical shape, and the insulating housing 14 around the first contact 11 and the second contact 12 are point-symmetric in shape, the signal lines of the first contact 11 and the second contact 12 in the receptacle connector 10 have identical characteristic impedance. Accordingly, the antenna signal of the antenna 2 can be compared in the inspecting circuit 4 with the antenna signal transmitted and received in the transmission/reception circuit 3, without considering the difference in loss of signal between the signal lines.

Figure 10:
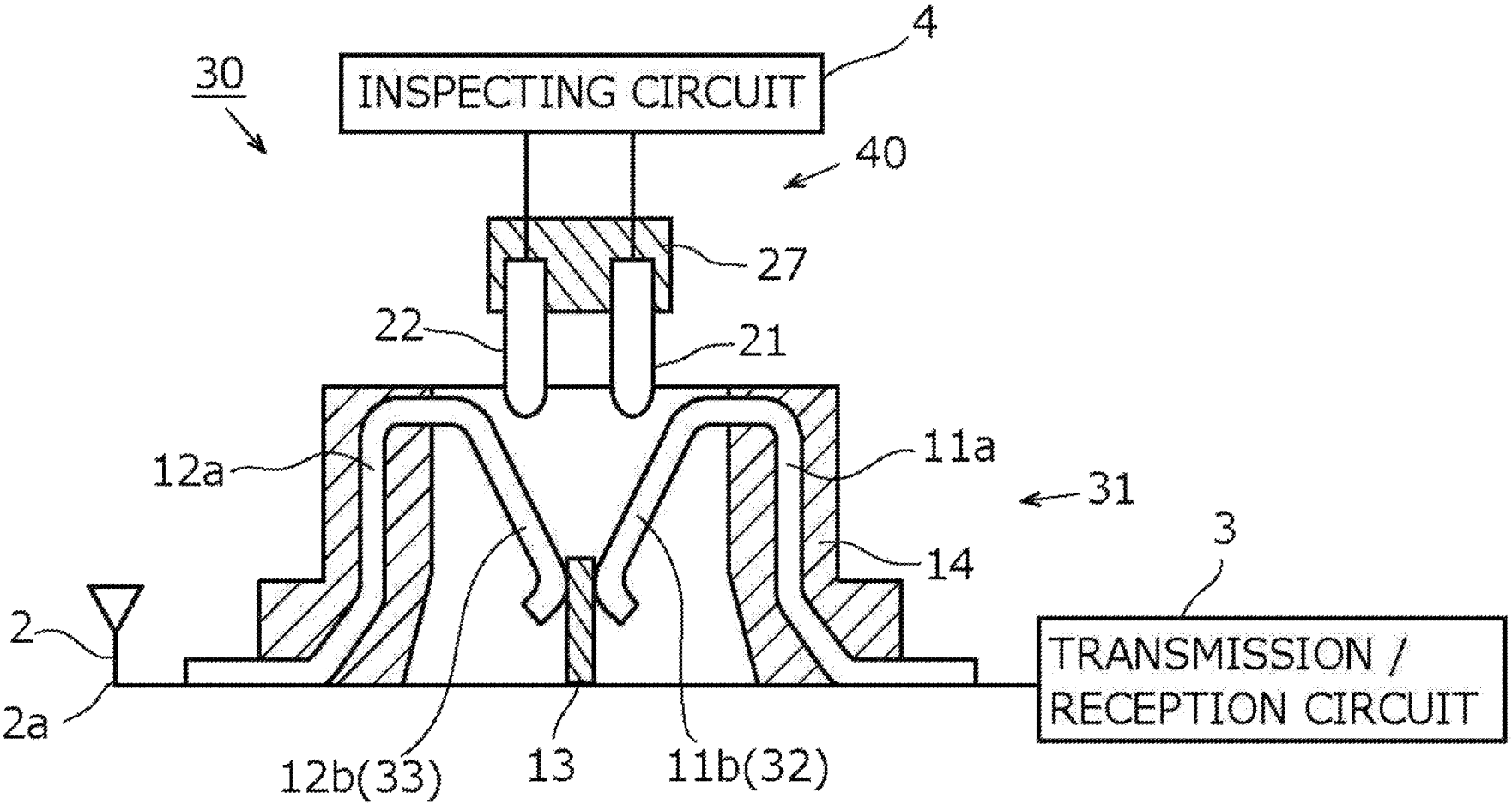
FIG. 10 is a vertical cross-sectional view showing a receptacle connector 31 before a plug 40 is connected in a connection switching device 30 according to a second embodiment.

A description will now be given of a connection switching device 30 according to a second embodiment of the present invention with reference to FIGS. 10 and 11. The connection switching device 30 is configured to insulate between a first contact 32 and a second contact 33 when a plug 40 is connected to a receptacle connector 31, without the insulating projection 24 according to the first embodiment provided in the plug 40. The component members of the connection switching device 30 identical or corresponding to the component members of the connection switching device 1 according to the first embodiment are designated by identical reference numeral in the drawings to omit the description thereof.

Although the first contact 32 and the second contact 33 that are attached to the insulating housing 14 of the receptacle connector 31 are identical in shape, they do not have the component members corresponding to the fixed contact pieces 11*c* and 12*c*. Instead, the first contact 32 and the second contact 33 are formed such that the first elastic contact piece 11*b* and the second elastic contact piece 12*b* are supported in a cantilever manner on the distal end of the fixed pieces 11*a* and 12*a* each fixed to the insulating housing 14. Therefore, as shown in FIG. 10, in the normal state where the plug 40 is not connected, the first elastic contact piece 11*b* of the first contact 32 and the second elastic contact piece 12*b* of the second contact 33 are in elastic contact with the side surfaces of the normally closed terminal 13, respectively. Consequently, the transmission/reception circuit 3 and the feeding point 2*a* of the antenna 2 are electrically connected, so that the transmission/reception circuit 3 transmits or receives an antenna signal through or from the antenna 2.

Although the plug 40 includes the first plug pin 21 and the second plug pin 22, which are identical in shape and projected from the insulator 27, at positions facing the first elastic contact piece 11*b* and the second elastic contact piece 12*b* of the receptacle connector 31, neither the insulating projection 24 nor the ground terminal 25 is projected between the first plug pin 21 and the second plug pin 22.

Figure 11:
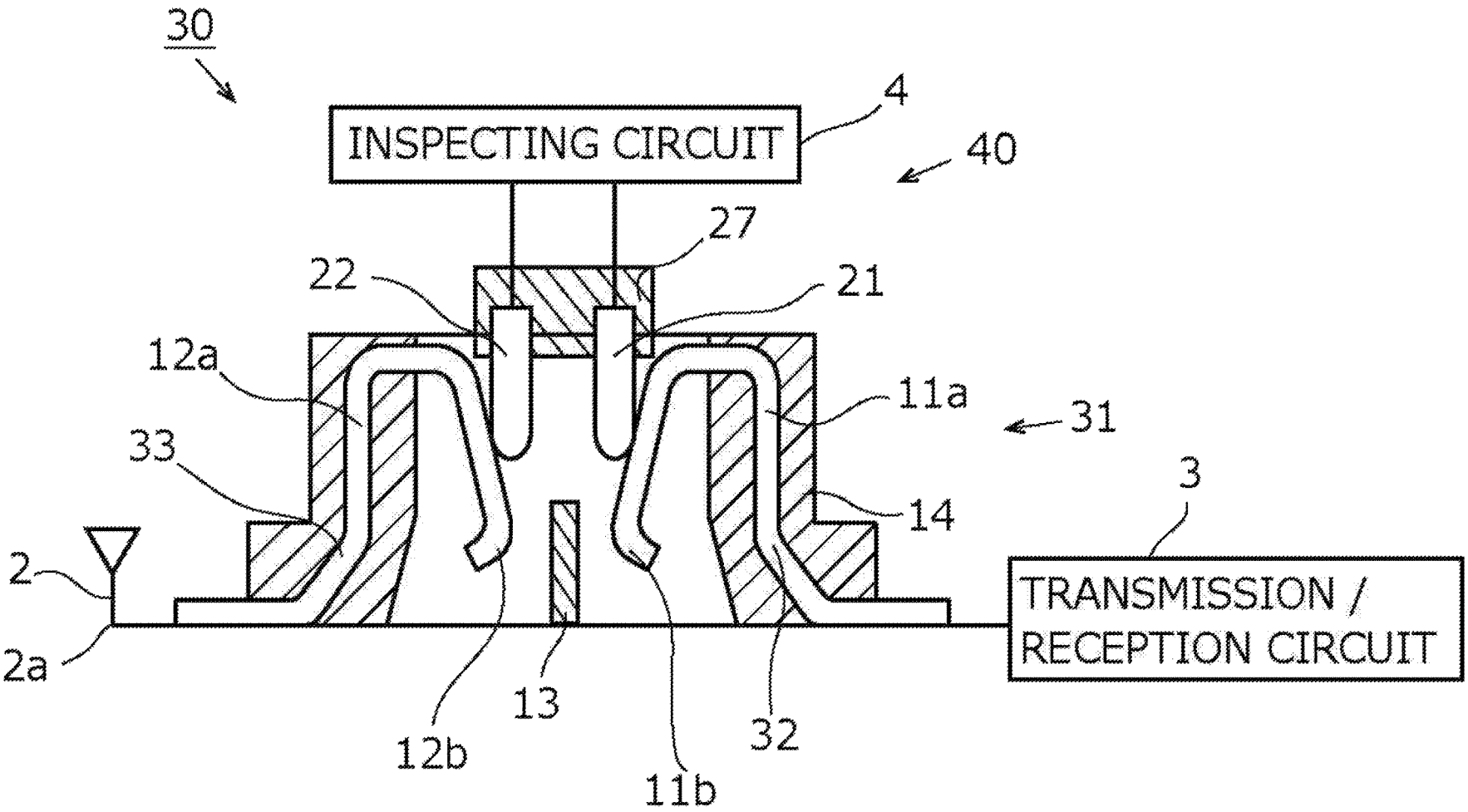
FIG. 11 is a vertical cross-sectional view showing the receptacle connector 31 in the state of being connected to the plug 20.
Figure 12:
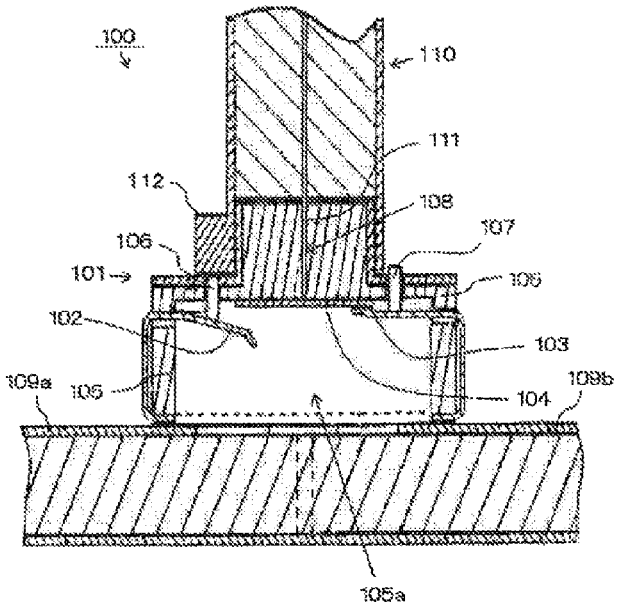
FIG. 12 Prior Art
FIG. 12 is a vertical cross-sectional view showing a conventional connection switching device 100 in the state where a plug 110 is connected to a receptacle connector 101.
Figure 13:
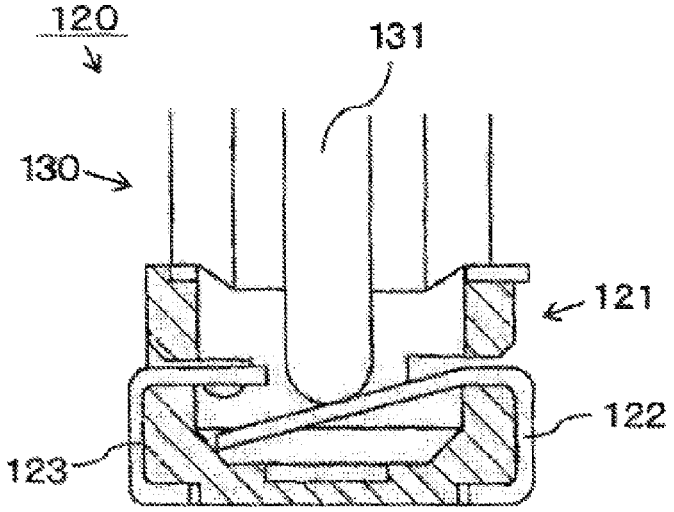
FIG. 13 Prior Art
FIG. 13 is a vertical cross-sectional view of a coaxial connector with a switch 121 of a conventional connection switching device 120.

As shown in FIG. 11, when the plug 40 is connected to the receptacle connector 31, the first plug pin 21 is brought into elastic contact with the first elastic contact piece 11*b*, and the second plug pin 22 is brought into elastic contact with the second elastic contact piece 12*b*, so that the first elastic contact piece 11*b* and the second elastic contact piece 12*b* are pressed downward in the drawing. As a result, the first elastic contact piece 11*b* and the second elastic contact piece 12*b* are electrically disconnected from the normally closed terminal 13, and the first contact 32 is insulated from the second contact 33. At the same time, the first elastic contact piece 11*b* of the first contact 32 is electrically connected to the first plug pin 21, and the second elastic contact piece 12*b* of the second contact 33 is electrically connected to the second plug pin 22. As a result, a connection between the antenna 2 and the transmission/reception circuit 3 is switched to a two-way connection composed of a connection between the inspecting circuit 4 and the transmission/reception circuit 3 and a connection between the inspecting circuit 4 and the antenna 2.

In the connection switching device 30 according to the present embodiment, the first contact 32 and the second contact 33 are also identical in shape, and the entire connection switching device 30 when the plug 40 is connected to the receptacle connector 31 is symmetric with respect to the normally closed terminal 13. Accordingly, a signal line connecting the first contact 32 and the first plug pin 21 and a signal line connecting the second contact 33 and the second plug pin 22 have identical high frequency signal characteristics, such as characteristic impedance, and therefore the antenna signal of the antenna 2 can be compared with the antenna signal transmitted and received in the transmission/reception circuit 3 without considering the difference in loss of signal between the individual signal lines.

Also in the connection switching device 30, the plug 40 may be provided with the ground terminal 25 connected to the ground, the ground terminal 25 being projected between the first plug pin 21 and the second plug pin 22. After the first plug pin 21 is brought into elastic contact with the first elastic contact piece 11*b*, and the second plug pin 22 is brought into elastic contact with the second elastic contact piece 12*b*, the ground terminal 25 may electrically be connected to the normally closed terminal 13, and the normally closed terminal 13 having the electric potential changed to the ground potential may be used to disconnect the signal line connecting the first plug pin 21 and the first contact 32 from the signal line connecting the second plug pin 22 and the second contact 33.

When there is little need to shield the signal line connecting the first plug pin 21 and the first contact 11 from the signal line connecting the second plug pin 22 and the second contact 12 in the connection switching device 1 according to the first embodiment, it is not necessary to provide the plug 20 with the ground terminal 25.

The present invention is not limited to the embodiments disclosed but accommodates various modifications. For example, the first contact 11 and the second contact 12, or the first contact 32 and the second contact 33 may be different in shape. When the normally closed terminal 13 that is attached to the center of the insulating housing 14 has a bilaterally symmetric shape like the first contact 32 and the second contact 33, the first contact 32 and the second contact 33 may be attached to the insulating housing 14 at positions symmetric with respect to the normally closed terminal 13.

In the above-described respective embodiments, the connection switching device that switches a connection between the antenna 2 and the transmission/reception circuit 3 to a two-way connection composed of a connection between the inspecting circuit 4 and the transmission/reception circuit 3 and a connection between the inspecting circuit 4 and the antenna 2 has been described. However, the present invention is applicable to any connection switching device as long as the connection switching device switches connections between the circuits that deliver an RF signal, even when the first plug pin 21, the second plug pin 22, the first contacts 11 and 32, and the second contacts 12 and 33 are connected to any circuit or circuit components.

The present invention is suitable as a connection switching device that switches a connection between an antenna and a transmission/reception circuit that transmits and receives an antenna signal to a two-way connection composed of a connection between the antenna and an inspecting circuit and a connection between the transmission/reception circuit and the inspecting circuit.

REFERENCE SIGNS LIST

1, 30 connection switching device
2*a* feeding point of antenna
3 transmission/reception circuit
4 inspecting circuit
10, 31 receptacle connector
11, 32 first contact
11*b* first elastic contact piece
11*d* first plate electrode portion
12, 33 second contact
12*b* second elastic contact piece
12*d* second plate electrode portion
13 normally closed terminal
14 insulating housing
20, 40 plug
21 first plug pin (probe)
22 second plug pin (probe)
24 insulating projection
25 ground terminal

The invention claimed is:

1. A connection switching device configured to connect a plug having a first plug pin to a receptacle connector, the receptacle connector having a first contact and a second contact that are attached to an insulating housing, the connection switching device being configured to switch an electrical connection between the first contact and the second contact to an electrical connection between the first contact and the first plug pin, wherein the receptacle connector includes: the first contact having a first elastic contact piece; the second contact having a second elastic contact piece; and a normally closed terminal that is attached between the first contact and the second contact of the insulating housing, the normally closed terminal being brought into elastic contact with the first elastic contact piece and the second elastic contact piece, the plug includes: the first plug pin; a second plug pin, and an insulating projection, the first plug pin being brought into contact with the first contact, the second plug pin being brought into contact with the second contact, and the insulating projection being inserted between the first elastic contact piece and the normally closed terminal and/or between the second elastic contact piece and the normally closed terminal to insulate between the first elastic contact piece and/or the second elastic contact piece and the normally closed terminal, when the plug is electrically connected to the receptacle connector, and when the receptacle connector and the plug are connected to each other, the first contact and the first plug pin are electrically connected to each other, and the second contact and the second plug pin are electrically connected to each other.

2. The connection switching device according to claim 1, wherein the plug includes: the first plug pin that is brought into contact with the first contact; the second plug pin that is brought into contact with the second contact; the insulating projection that is inserted between the first elastic contact piece and the normally closed terminal and between the second elastic contact piece and the normally closed terminal to insulate between the first elastic contact piece and the normally closed terminal and between the second elastic contact piece and the normally closed terminal; and a ground terminal that is connected to a ground, the ground terminal being projected along the insulating projection, and when the plug is connected to the receptacle connector, the ground terminal is brought into contact with the normally closed terminal.

3. The connection switching device according to claim 1, wherein the first contact is connected to a transmission/reception circuit that transmits and/or receives an antenna signal, the second contact is connected to a feeding point of the antenna, and the first plug pin and the second plug pin are probes that are connected to a detection circuit that detects an RF signal flowing to the transmission/reception circuit or to the antenna.

4. The connection switching device according to claim 1, wherein the first contact and the second contact are identical in shape.

5. The connection switching device according to claim 4, wherein the first contact and the second contact are attached to the insulating housing at positions point-symmetric with respect to the normally closed terminal.

6. The connection switching device according to claim 5, wherein a first plate electrode portion is integrally formed on a side of the first elastic contact piece of the first contact, the first plate electrode portion being brought into contact with the first plug pin of the plug, and a second plate electrode portion is integrally formed on a side of the second elastic contact piece of the second contact, the second plate electrode portion being brought into contact with the second plug pin of the plug.

7. A connection switching device configured to connect a plug having a first plug pin to a receptacle connector, the receptacle connector having a first contact and a second contact that are attached to an insulating housing, the connection switching device being configured to switch an electrical connection between the first contact and the second contact to an electrical connection between the first contact and the first plug pin, wherein the receptacle connector includes: the first contact having a first elastic contact piece; the second contact having a second elastic contact piece; and a normally closed terminal that is attached between the first contact and the second contact in the insulating housing, the normally closed terminal being brought into elastic contact with the first elastic contact piece and the second elastic contact piece, the plug includes: the first plug pin; and a second plug pin, the first plug pin being brought into contact with the first elastic contact piece to separate the first elastic contact piece from the normally closed terminal, the second plug pin being brought into contact with the second elastic contact piece to separate the second elastic contact piece from the normally closed terminal, when the plug is connected to the receptacle connector, and when the receptacle connector and the plug are connected to each other, the first contact and the first plug pin are electrically connected to each other, and the second contact and the second plug pin are electrically connected to each other.

8. The connection switching device according to claim 7, wherein the plug includes: the first plug pin; the second plug pin that is brought into contact with the second elastic contact piece to separate the second elastic contact piece from the normally closed terminal; and a ground terminal that is connected to a ground, and when the plug is connected to the receptacle connector, the ground terminal is brought into contact with the normally closed terminal.

9. The connection switching device according to claim 7, wherein the first contact is connected to a transmission/reception circuit that transmits and/or receives an antenna signal, the second contact is connected to a feeding point of the antenna, and the first plug pin and the second plug pin are probes that are connected to a detection circuit that detects an RF signal flowing to the transmission/reception circuit or to the antenna.

10. The connection switching device according to claim 2, wherein the first contact is connected to a transmission/reception circuit that transmits and/or receives an antenna signal, the second contact is connected to a feeding point of the antenna, and the first plug pin and the second plug pin are probes that are connected to a detection circuit that detects an RF signal flowing to the transmission/reception circuit or to the antenna.

11. The connection switching device according to claim 2, wherein the first contact and the second contact are identical in shape.

12. The connection switching device according to claim 3, wherein the first contact and the second contact are identical in shape.

13. The connection switching device according to claim 10, wherein the first contact and the second contact are identical in shape.

14. The connection switching device according to claim 11, wherein the first contact and the second contact are attached to the insulating housing at positions point-symmetric with respect to the normally closed terminal.

15. The connection switching device according to claim 12, wherein the first contact and the second contact are attached to the insulating housing at positions point-symmetric with respect to the normally closed terminal.

16. The connection switching device according to claim 13, wherein the first contact and the second contact are attached to the insulating housing at positions point-symmetric with respect to the normally closed terminal.

17. The connection switching device according to claim 14, wherein a first plate electrode portion is integrally formed on a side of the first elastic contact piece of the first contact, the first plate electrode portion being brought into contact with the first plug pin of the plug, and a second plate electrode portion is integrally formed on a side of the second elastic contact piece of the second contact, the second plate electrode portion being brought into contact with the second plug pin of the plug.

18. The connection switching device according to claim 15, wherein a first plate electrode portion is integrally formed on a side of the first elastic contact piece of the first contact, the first plate electrode portion being brought into contact with the first plug pin of the plug, and a second plate electrode portion is integrally formed on a side of the second elastic contact piece of the second contact, the second plate electrode portion being brought into contact with the second plug pin of the plug.

19. The connection switching device according to claim 16, wherein a first plate electrode portion is integrally formed on a side of the first elastic contact piece of the first contact, the first plate electrode portion being brought into contact with the first plug pin of the plug, and a second plate electrode portion is integrally formed on a side of the second elastic contact piece of the second contact, the second plate electrode portion being brought into contact with the second plug pin of the plug.

20. The connection switching device according to claim 8, wherein the first contact is connected to a transmission/reception circuit that transmits and/or receives an antenna signal, the second contact is connected to a feeding point of the antenna, and the first plug pin and the second plug pin are probes that are connected to a detection circuit that detects an RF signal flowing to the transmission/reception circuit or to the antenna.

* * * * *